US010325556B2

(12) United States Patent
Yamamoto

(10) Patent No.: US 10,325,556 B2
(45) Date of Patent: Jun. 18, 2019

(54) DISPLAY PANEL AND DISPLAY UNIT

(71) Applicant: JOLED Inc., Tokyo (JP)

(72) Inventor: Tetsuro Yamamoto, Tokyo (JP)

(73) Assignee: JOLED Inc., Tokyo (JP)

( * ) Notice: Subject to any disclaimer, the term of this patent is extended or adjusted under 35 U.S.C. 154(b) by 0 days.

(21) Appl. No.: 15/829,478

(22) Filed: Dec. 1, 2017

(65) Prior Publication Data

US 2018/0182290 A1 Jun. 28, 2018

(30) Foreign Application Priority Data

Dec. 22, 2016 (JP) ..... 2016-249338

(51) Int. Cl.
*G09G 3/3233* (2016.01)
*G09G 3/3225* (2016.01)

(52) U.S. Cl.
CPC ..... *G09G 3/3233* (2013.01); *G09G 3/3225* (2013.01); *G09G 2300/0809* (2013.01); *G09G 2300/0814* (2013.01); *G09G 2300/0819* (2013.01); *G09G 2300/0852* (2013.01); *G09G 2310/0245* (2013.01); *G09G 2310/0251* (2013.01); *G09G 2320/045* (2013.01); *G09G 2320/0626* (2013.01)

(58) Field of Classification Search
CPC ..... G09G 3/3233; G09G 2300/0842; H01L 27/3244; H01L 27/3262; G02F 1/13306
See application file for complete search history.

(56) References Cited

U.S. PATENT DOCUMENTS

2009/0201235 A1* 8/2009 Kane ..... G09G 3/3241 345/82
2013/0249883 A1 9/2013 Hwang
2015/0161940 A1* 6/2015 Woo ..... G09G 3/003 345/58
2015/0379939 A1* 12/2015 Takasugi ..... G09G 5/18 345/690

FOREIGN PATENT DOCUMENTS

JP 2013200541 A 10/2013

* cited by examiner

*Primary Examiner* — Gerald Johnson
(74) *Attorney, Agent, or Firm* — Michael Best & Friedrich LLP

(57) ABSTRACT

A display panel according to an embodiment of the technology is provided with a plurality of pixels. The pixels each include a light-emitting device and a pixel circuit. Each pixel circuit includes a memory circuit. The memory circuit includes a storage capacitor and a first switching transistor. The storage capacitor is configured to store a signal voltage. The first switching transistor is provided between a gate of a driving transistor and the storage capacitor. The memory circuit further includes a second switching transistor. The second switching transistor is provided between the storage capacitor and the first switching transistor, or provided on side opposite to the first switching transistor with respect to the storage capacitor.

9 Claims, 8 Drawing Sheets

DISPLAY PANEL AND DISPLAY UNIT

CROSS REFERENCE TO RELATED APPLICATIONS

This application claims the benefit of Japanese Priority Patent Application JP 2016-249338 filed on Dec. 22, 2016, the entire contents of which are incorporated herein by reference.

BACKGROUND

The technology relates to a display panel and a display unit.

In the technical field of display units that display an image, recently, a display unit utilizing, as a light-emitting device of a pixel, a current-driven optical device such as an organic electroluminescence (EL) device has been developed, and increasingly commercialized. The current-driven optical device has emission luminance which varies depending on a value of a flowing current. The organic EL device is a self-light-emitting device unlike a device such as a liquid crystal device. The display unit utilizing the organic EL device (organic EL display unit) therefore does not need a light source (backlight), thus enabling the organic EL display unit to be more lightweight and thinner, and to have higher luminance than a liquid crystal display unit that needs a light source. Further, the organic EL device has a very high response speed of about several micro seconds, thus preventing the occurrence of an afterimage during display of a motion picture. Hence, the organic EL display unit is expected to be a mainstream next-generation flat panel display.

An active-matrix organic EL display unit has a configuration in which each scanning line is sequentially scanned for one horizontal period (1H), and a signal voltage corresponding to an image signal is sampled and is written into a storage capacitor. That is, the line sequential scanning in a 1H cycle allows for the writing operation of the signal voltage. When a threshold voltage and mobility of a driving transistor differ for each pixel, the organic EL device may have irregular emission luminance in the organic EL display unit, resulting in impaired uniformity of a screen. Thus, the active-matrix organic EL display unit performs a correction operation that reduces the irregular emission luminance caused by the irregular threshold voltage and the irregular mobility of the driving transistor, in addition to the line sequential scanning in the 1H cycle. For example, reference is made to Japanese Unexamined Patent Application Publication No. 2013-200541.

SUMMARY

The disclosure of the above-mentioned Japanese Unexamined Patent Application Publication No. 2013-200541 has an issue in which a correction capability to be obtained by the above-described correction operation is not very high.

It is desirable to provide a display panel and a display unit that make it possible to improve a correction capability to be obtained by a correction operation.

A display panel with a plurality of pixels, the pixels each including a light-emitting device and a pixel circuit, the pixel circuit including a driving transistor configured to control a current flowing into the light-emitting device, a memory circuit configured to store a signal voltage corresponding to an image signal, and apply the stored signal voltage to a gate of the driving transistor, a writing transistor configured to write the signal voltage into the memory circuit, and a first storage capacitor provided between the gate of the driving transistor and an anode of the light-emitting device, the memory circuit including a second storage capacitor configured to store the signal voltage, a first switching transistor provided between the gate of the driving transistor and the second storage capacitor, and a second switching transistor that is provided between the second storage capacitor and the first switching transistor, or provided on side opposite to the first switching transistor with respect to the second storage capacitor.

A display unit including: a display panel with a plurality of pixels, the pixels each including a light-emitting device and a pixel circuit; and a driving circuit configured to drive the plurality of pixels, the pixel circuit including a driving transistor configured to control a current flowing into the light-emitting device, a memory circuit configured to store a signal voltage corresponding to an image signal, and apply the stored signal voltage to a gate of the driving transistor, a writing transistor configured to write the signal voltage into the memory circuit, and a first storage capacitor provided between the gate of the driving transistor and an anode of the light-emitting device, the memory circuit including a second storage capacitor configured to store the signal voltage, a first switching transistor provided between the gate of the driving transistor and the second storage capacitor, and a second switching transistor that is provided between the second storage capacitor and the first switching transistor, or provided on side opposite to the first switching transistor with respect to the second storage capacitor.

BRIEF DESCRIPTION OF THE DRAWINGS

The accompanying drawings are included to provide a further understanding of the disclosure, and are incorporated in and constitute a part of this specification. The drawings illustrate example embodiments and, together with the specification, serve to explain the principles of the technology.

DETAILED DESCRIPTION

Figure 1:
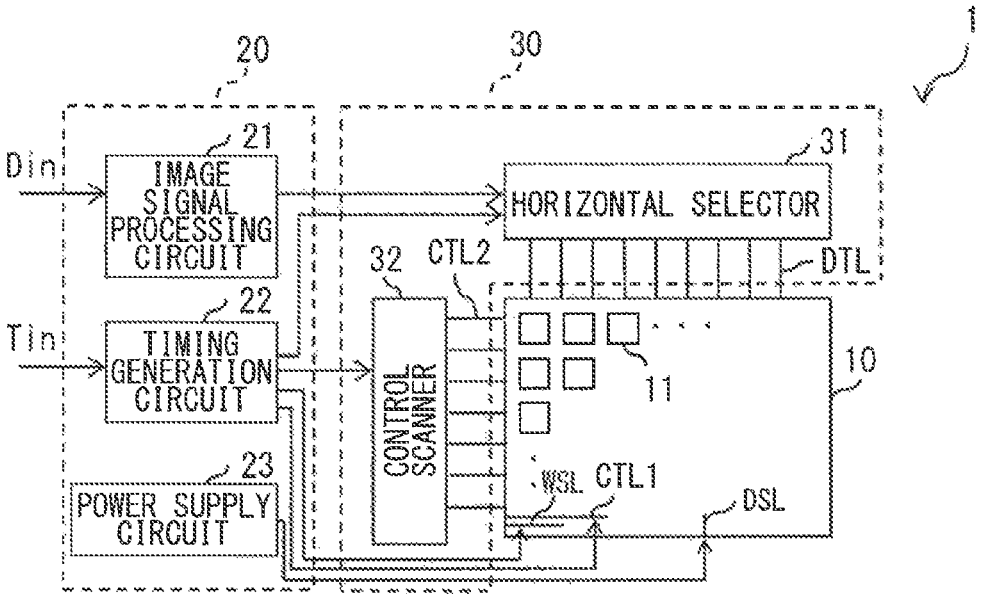
FIG. 1 is a schematic configuration diagram of a display unit according to an embodiment of the technology.

Some example embodiments of the technology are described below in detail with reference to the accompanying drawings.

It is to be noted that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. It is to be noted that the like elements are denoted with the same reference numerals, and any redundant description thereof will not be described in detail. It is to be noted that the description is given in the following order.

1. Example Embodiment (Display Unit)
2. Modification Example (Display Unit)
3. Application Example (Electronic Apparatus)

[1. Example Embodiment]

[Configuration]

FIG. 1 illustrates a schematic configuration of a display unit 1 according to an embodiment of the technology. The display unit 1 includes a display panel 10, a controller 20, and a driver 30, for example. The controller 20 and the driver 30 correspond to a specific but non-limiting example of a "driving circuit" according to an embodiment of the technology. In the display panel 10, a plurality of pixels 11 are disposed in matrix. The controller 20 and the driver 30 may drive the plurality of pixels 11 on the basis of an image signal Din and a synchronizing signal Tin which are inputted from the outside.

[Display Panel 10]

Figure 2:
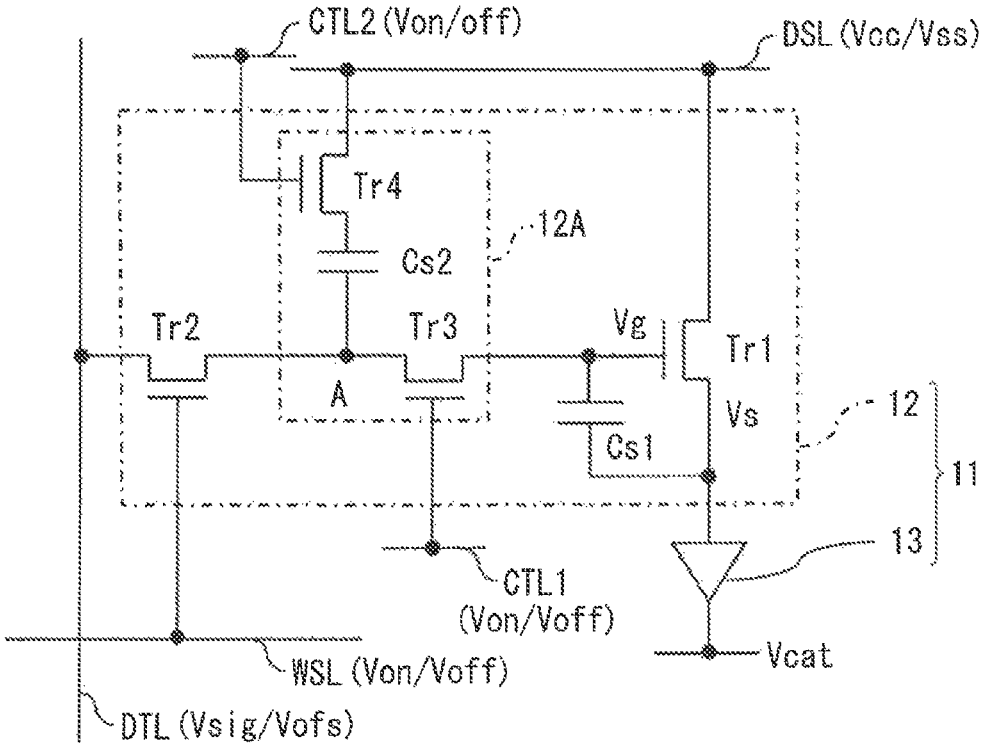
FIG. 2 illustrates an example of a circuit configuration of each of pixels illustrated in FIG. 1.

FIG. 2 illustrates an example of a circuit configuration of each of the pixels 11 included in the display panel 10. The controller 20 and the driver 30 may active-matrix-drive each of the pixels 11 to allow the display panel 10 to display an image based on the image signal Din and the synchronizing signal Tin which are inputted from the outside. The display panel 10 may include, for example, a plurality of control lines WSL extending in a row direction, a plurality of control lines CTL1 and a plurality of control lines CTL2 both extending in a row direction, and a plurality of signal lines DTL and a plurality of power supply lines DSL both extending in a column direction. It is to be noted that the plurality of power supply lines DSL may extend in a row direction. The display panel 10 further includes the plurality of pixels 11. Each one of the plurality of pixels 11 may be provided for every location at which corresponding one of the control lines WSL and corresponding one of the signal lines DTL intersect with each other.

The control line WSL may select each of the pixels 11. The signal line DTL may supply to corresponding one of the pixels 11 a signal voltage Vsig in accordance with the image signal Din. The signal line DTL may supply to corresponding one of the pixels 11 a data pulse that includes the signal voltage Vsig. The power supply line DSL may supply power to corresponding one of the pixels 11. The control line CTL1 may supply to corresponding one of the pixels 11 a control pulse that performs ON/OFF control of a switching transistor Tr3 described later. The control line CTL 2 may supply to corresponding one of the pixels 11 a control pulse that performs ON/OFF control of a switching transistor Tr4 described later. The switching transistor Tr3 corresponds to a specific but non-limiting example of a "first switching transistor" according to an embodiment of the technology. The switching transistor Tr4 corresponds to a specific but non-limiting example of a "second switching transistor" according to an embodiment of the technology.

Each of the pixels 11 includes a pixel circuit 12 and an organic EL device 13, for example. The organic EL device 13 corresponds to a specific but non-limiting example of a "light-emitting device" according to an embodiment of the technology. The organic EL device 13 may have a configuration in which an anode electrode, an organic layer, and a cathode electrode are stacked in order, for example. The organic EL device 13 may have a device capacitor, i.e., a device capacitor Ce1 described later. The pixel circuit 12 may control emission and extinction of the organic EL device 13. The pixel circuit 12 may serve to store a voltage written into corresponding one of the pixels 11 by means of write scanning described later. The pixel circuit 12 includes a driving transistor Tr1, a writing transistor Tr2, a storage capacitor Cs, and a memory circuit 12A, for example. The memory circuit 12A includes switching transistors Tr3 and Tr4 and a storage capacitor Cs2, for example. The storage capacitor Cs1 corresponds to a specific but non-limiting example of a "first storage capacitor" according to an embodiment of the technology. The storage capacitor Cs2 corresponds to a specific but non-limiting example of a "second storage capacitor" according to an embodiment of the technology.

The writing transistor Tr2 may control writing of the signal voltage Vsig to the memory circuit 12A. The signal voltage Vsig corresponds to the image signal Din. In a specific but non-limiting example, the writing transistor Tr2 may sample a voltage of the signal line DTL, and write the voltage obtained by the sampling into the memory circuit 12A. The driving transistor Tr1 may be coupled in series to the organic EL device 13. The driving transistor Tr1 may drive the organic EL device 13. The driving transistor Tr1 may control a current flowing into the organic EL device 13 depending on magnitude of the voltage sampled by the writing transistor Tr2.

The storage capacitor Cs1 may store a predetermined voltage between a gate and a source of the driving transistor Tr1. The storage capacitor Cs1 is provided between the gate of the driving transistor Tr1 and the anode of the organic EL device 13.

The memory circuit 12A stores the signal voltage Vsig, and applies the stored signal voltage Vsig to the gate of the driving transistor Tr1. The storage capacitor Cs2 stores the signal voltage Vsig. The switching transistor Tr3 is provided between the gate of the driving transistor Tr1 and the storage capacitor Cs2. Further, the switching transistor Tr3 may be provided between the gate of the driving transistor Tr1 and a source or a drain of the writing transistor Tr2. The switching transistor Tr4 is provided on side opposite to the switching transistor Tr3 with respect to the storage capacitor Cs2. In a specific but non-limiting example, the switching transistor Tr4 may be provided between the storage capacitor Cs2 and the power supply line DSL. It is to be noted that the pixel circuit 12 may have a circuit configuration in which various capacitors or transistors are added to the above-described circuit including four transistors (Tr) and two capacitors (C), i.e., 4Tr2C; in an alternative embodiment, the pixel circuit 12 may have a circuit configuration different from that of the above-described 4Tr2C.

The driving transistor Tr1, the writing transistor Tr2, and the switching transistors Tr3 and Tr4 may be each formed of n-channel metal oxide semiconductor (MOS) thin film transistor (TFT), for example. It is to be noted that these transistors may be each formed of p-channel MOS TFT. The following description is given on the assumption that these transistors are of enhancement type. However, in one embodiment, these transistors may be of depression type.

Each of the signal lines DTL may be coupled to an output end of a horizontal selector 31 described later and to the source or the drain of the writing transistor Tr2. Each of the control lines WSL may be coupled to one of output ends of a timing generation circuit 22 described later and to a gate of the writing transistor Tr2. Each of the power supply lines DSL may be coupled to an output end of a power supply circuit 23 described later and to the source or the drain of the driving transistor Tr1. Each of the power supply lines DSL may be further coupled to the output end of the power supply circuit 23 and to a source or a drain of the switching transistor Tr4. The power supply lines may be electrically coupled to one another, and thus may have a common potential. In each of the pixels 11, the source or the drain of the driving transistor Tr1 may be electrically coupled to one of the plurality of power supply lines DSL that have a mutually common potential. Each of the control lines CTL1 may be coupled to the other of the output ends of the timing generation circuit 22 described later and to a gate of the switching transistor Tr3. Each of the control lines CTL2 may be coupled to an output end of a control scanner 32 described later and to a gate of the switching transistor Tr4.

The gate of the writing transistor Tr2 may be coupled to corresponding one of the control lines WSL. The source or the drain of the writing transistor Tr2 may be coupled to corresponding one of the signal lines DTL. A terminal, of the source and the drain of the writing transistor Tr2, that is not coupled to the corresponding one of the signal lines DTL may be coupled to a source or a drain of the switching transistor Tr3. The terminal, of the source and the drain of the writing transistor Tr2, that is not coupled to the corresponding one of the signal lines DTL may be coupled further to one end of the storage capacitor Cs2. The gate of the switching transistor Tr3 may be coupled to corresponding one of the control lines CTL1. The source or the drain of the switching transistor Tr3 may be coupled one end of the storage capacitor Cs2 and to the terminal, of the source and the drain of the writing transistor Tr2, that is not coupled to the corresponding one of the signal lines DTL. A terminal, of the source and the drain of the switching transistor Tr3, that is coupled neither to the writing transistor Tr2 nor to the storage capacitor Cs2 may be coupled to the gate of the driving transistor Tr1 and to one end of the storage capacitor Cs1. The gate of the driving transistor Tr1 may be coupled to one end of the storage capacitor Cs1 and to the terminal, of the source and the drain of the switching transistor Tr3, that is coupled neither to the storage capacitor Cs2 nor to the writing transistor Tr2. The source or the drain of the driving transistor Tr1 may be coupled to corresponding one of the power supply lines DSL. A terminal, of the source and the drain of the switching transistor Tr1, that is not coupled to the corresponding one of the power supply lines DSL may be coupled to the anode of the organic EL device 13 and to the other end of the storage capacitor Cs1. One end of the storage capacitor Cs1 may be coupled to the gate of the driving transistor Tr1. The other end of the storage capacitor Cs1 may be coupled to the terminal, of the source and the drain of the switching transistor Tr1, that is not coupled to the corresponding one of the power supply lines DSL. One end of the storage capacitor Cs2 may be coupled to the terminal, of the source and the drain of the writing transistor Tr2, that is not coupled to the corresponding one of the signal lines DTL. One end of the storage capacitor Cs2 may be further coupled to a terminal, of the source and the drain of the switching transistor Tr3, that is not coupled to the gate of the driving transistor Tr1. The other end of the storage capacitor Cs2 may be coupled to a source or a drain of the switching transistor Tr4. The gate of the switching transistor Tr4 may be coupled to correspond one of the control lines CTL2. The source or the drain of the switching transistor Tr4 may be coupled to the storage capacitor Cs2. A terminal, of the source and the drain of the switching transistor Tr4, on side opposite to the storage capacitor Cs2 may be coupled to the corresponding one of the power supply lines DSL.

The driver 30 may include the horizontal selector 31 and the control scanner 32, for example.

The horizontal selector 31 may apply to each of the signal lines DTL an analog signal voltage Vsig inputted from an image signal processing circuit 21 in response to (in synchronization with) the input of a control signal, for example. The horizontal selector 31 may be able to output two types of voltages (i.e., Vofs and Vsig), for example. In a specific but non-limiting example, the horizontal selector 31 may supply the two types of voltages (i.e., Vofs and Vsig) to a pixel 11 selected by the timing generation circuit 22 via corresponding one of the signal lines DTL. The signal voltage Vsig may have a voltage value corresponding to the image signal Din. The fixed voltage Vofs may be a constant voltage irrelevant to the image signal Din. The minimum voltage of the signal voltage Vsig may have a voltage value lower than the fixed voltage Vofs. The maximum voltage of the signal voltage Vsig may have a voltage value higher than the fixed voltage Vofs. The horizontal selector 31 may output a data pulse including the signal voltage Vsig to each of the signal lines DTL for one horizontal period. The horizontal selector 31 may output to each of the signal lines DTL a pulse having two values of the signal voltage Vsig and the fixed voltage Vofs, as a data pulse.

The control scanner 32 may control ON/OFF operation of the switching transistor Tr4 of each of the pixels 11 in response to (in synchronization with) the input of the control signal, for example. The control scanner 32 may be able to output two types of voltages (i.e., Von and Voff), for example. In a specific but non-limiting example, the control scanner 32 may supply the two types of voltages (i.e., Von and Voff) to a pixel 11 to be driven via corresponding one of the control lines CTL2 to perform the ON/OFF control of the switching transistor Tr4. The ON-voltage Von may be a value equal to or higher than the ON-voltage of the switching transistor Tr4. The OFF-voltage Voff may be a value lower than the ON-voltage of the switching transistor Tr4 and may be a value lower than the ON-voltage Von.

The control scanner 32 may scan a plurality of pixels 11 for each predetermined unit during memory writing described later. In a specific but non-limiting example, the control scanner 32 may sequentially output a control pulse to each of the control lines CTL2 in one frame period. The control scanner 32 may select the plurality of control lines CTL2 through a predetermined sequence in response to (in synchronization with) the input of the control pulse, for example, to thereby cause the memory writing to be executed in a desired order. As used herein, the term "memory writing" refers to writing the signal voltage Vsig into the memory circuit 12A (i.e., storage capacitor Cs2).

[Controller 20]

Description is given next of the controller 20. The controller 20 may include the image signal processing circuit 21, the timing generation circuit 22, and the power supply circuit 23, for example.

The image signal processing circuit 21 may perform a predetermined correction to a digital image signal Din inputted from the outside, for example, and may generate the signal voltage Vsig on the basis of the image signal obtained by the predetermined correction. The image signal processing circuit 21 may output the generated signal voltage Vsig to the horizontal selector 31, for example. Non-limiting examples of the predetermined correction may include gamma correction and overdrive correction.

The timing generation circuit 22 may control circuits in the driver 30 to operate in conjunction with one another. The timing generation circuit 22 may output a control signal to each of the circuits in the driver 30 in response to (in synchronization with) a synchronizing signal Tin inputted from the outside, for example. The timing generation circuit 22 may further output a predetermined control signal to each of the control lines CTL1 and each of the control lines WSL in the display panel 10. The timing generation circuit 22 may be able to output the two types of voltages (i.e., Von and Voff), for example. In a specific but non-limiting example, the timing generation circuit 22 may supply the two types of voltages (i.e., Von and Voff) to a pixel 11 to be driven via corresponding one of the control lines CTL1 and corresponding one of the control lines WSL to perform the ON/OFF control of each of the writing transistor Tr2 and the switching transistor Tr3. The ON-voltage Von may be a value equal to or higher than an ON-voltage of each of the writing transistor Tr2 and the switching transistor Tr3. The OFF-voltage Voff may be a value lower than the ON-voltage of each of the writing transistor Tr2 and the switching transistor Tr3, and may be a value lower than the ON-voltage Von.

The power supply circuit 23 may generate various fixed voltages necessary for various circuits, and may supply the generated various fixed voltages. Non-limiting examples of the various circuits may include the horizontal selector 31, the control scanner 32, the image signal processing circuit 21, and the timing generation circuit 22. The power supply circuit 23 may further generate various fixed voltages necessary for each of the power supply lines DSL in the display panel 10, and may supply the generated various fixed voltages.

[Operation]

Description is given next of operations (from extinction operation to emission operation) of the display unit 1 according to the present example embodiment. The present example embodiment may incorporate a compensation operation for variation in I-V characteristics of the organic EL device 13, in order to keep emission luminance of the organic EL device 13 constant without being affected by possible temporal change in the I-V characteristics of the organic EL device 13. Further, the present example embodiment may incorporate a compensation operation for variation in a threshold voltage and mobility of the driving transistor Tr1, in order to keep the emission luminance of the organic EL device 13 constant without being affected by possible temporal change in the threshold voltage and the mobility of the driving transistor Tr1.

Figure 3:
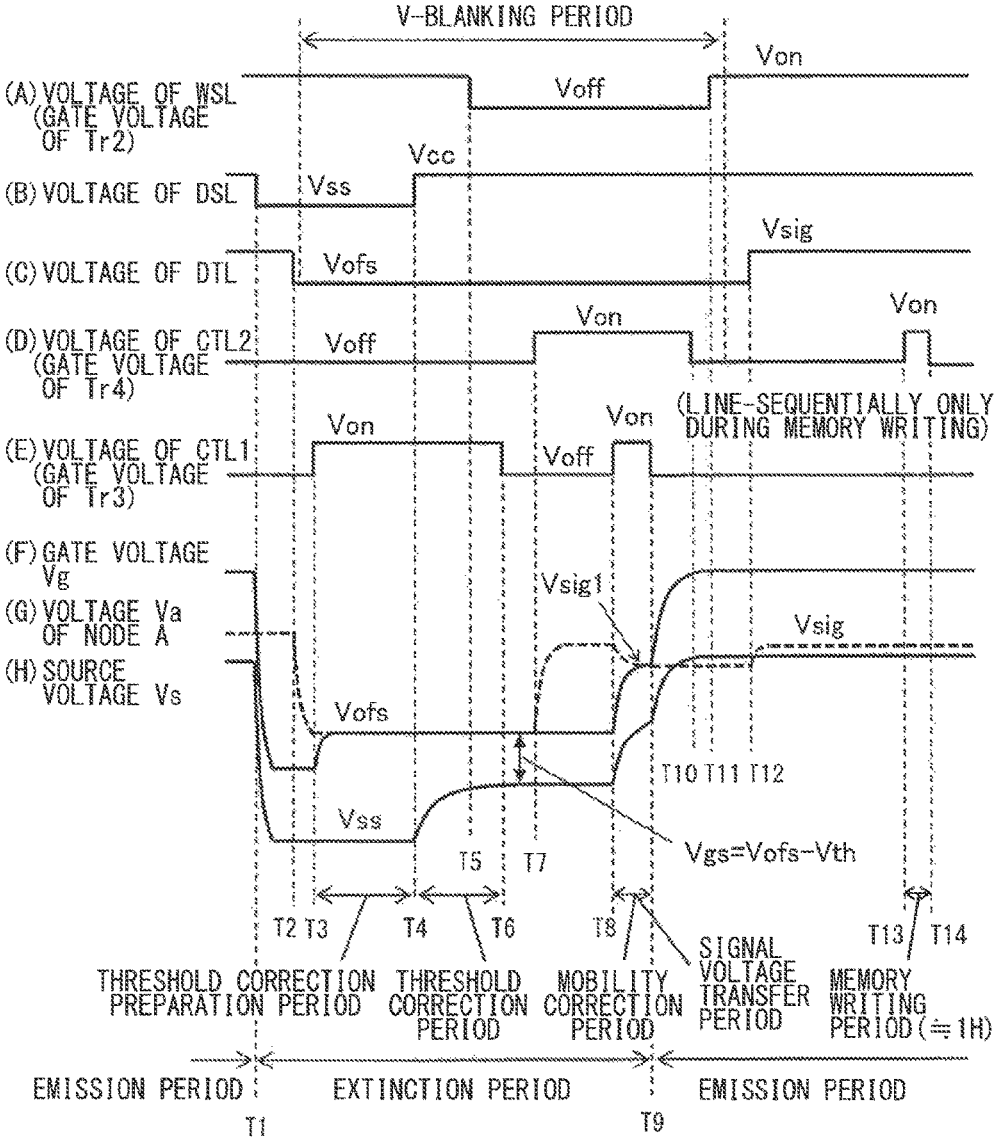
FIG. 3 illustrates an example of a temporal change in each of voltages to be applied to a power supply line, a signal line, and control lines, a gate voltage and a source voltage of a driving transistor, and a voltage at a node A.
Figure 4:
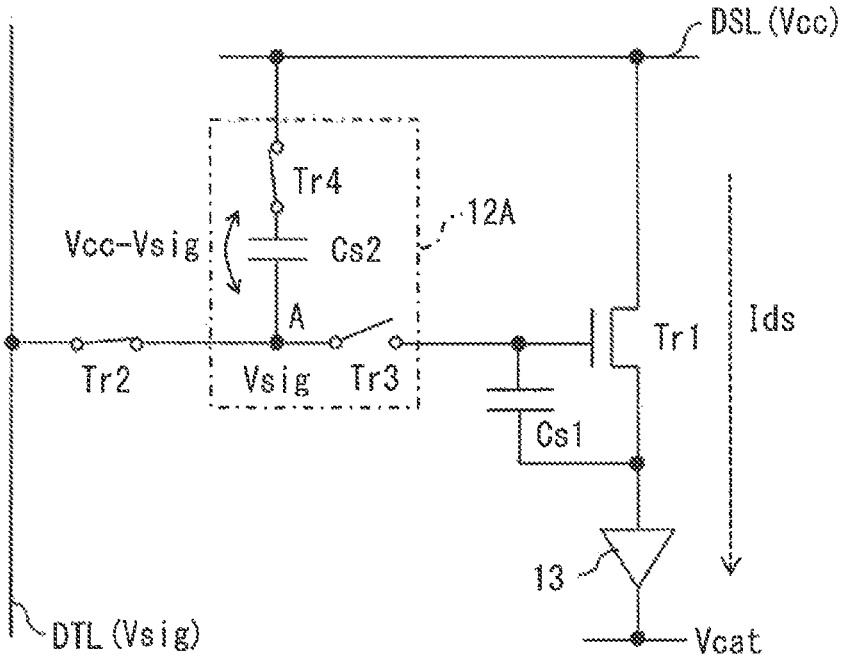
FIG. 4 illustrates an example of an operation of a pixel.

In FIG. 3, the term "threshold correction preparation" refers to initializing a gate voltage of the driving transistor Tr1 (refers to changing the gate voltage to Vofs, in a specific but non-limiting example), and initializing a source voltage of the driving transistor Tr1 (refers to changing the source voltage to Vss, in a specific but non-limiting example). The term "threshold correction" refers to a correction operation in which the gate-source voltage Vgs of the driving transistor Tr1 is made closer to a threshold voltage Vth of the driving transistor Tr1. The term "mobility correction" refers to a correction operation in which a voltage stored between the gate and the source of the driving transistor Tr1 (gate-source voltage Vgs) is corrected depending on magnitude of mobility of the driving transistor Tr1. Signal voltage transfer and the mobility correction may be performed at different timings in some cases. According to the present example embodiment, the signal writing and the mobility correction may be performed together (or continuously without an interval). The signal voltage transfer refers to an operation in which the signal voltage Vsig written into the memory circuit 12A (i.e., storage capacitor Cs2) is transferred to the gate of the driving transistor Tr1.

FIG. 3 illustrates an example of a temporal change in each of voltages to be applied to the control line WSL, the power supply line DSL, the signal line DTL, and the control lines CTL1 and CTL 2, a gate voltage Vg and a source voltage Vs of the driving transistor Tr1, and a voltage Va at a node A. FIGS. 4 to 7 and 9 to 11 each illustrate an example of an operation of the pixel 11. FIG. 8 illustrates an example of a temporal change in the source voltage Vs of the driving transistor Tr1.

It is to be noted that a voltage of the power supply line DSL is a voltage that is applied simultaneously to all of the power supply lines DSL in the display panel 10. A voltage of the control line CTL1 may also be a voltage that is applied simultaneously to all of the control lines CTL1 in the display panel 10. An ON-voltage in the control line CTL2 during extinction may be a voltage that is applied simultaneously to all of the control lines CTL2 in the display panel 10. An ON-voltage in the control line CTL2 during emission may be a voltage that is applied line-sequentially to each of the control lines CTL2 in the display panel 10.

[Memory Writing]

First, the controller 20 and the driver 30 may write the signal voltage Vsig into the memory circuit 12A (i.e., storage capacitor Cs2). In a specific but non-limiting example, the controller 20 and the driver 30 may write the signal voltage Vsig into the memory circuit 12A (i.e., storage capacitor Cs2) on a pixel row basis when each organic EL device 13 emits light. In other words, the controller 20 and the driver 30 may write, on a pixel row basis, the signal voltage Vsig into the memory circuit 12A (i.e., storage capacitor Cs2) by turning, on a pixel row basis, each switching transistor Tr4 ON, with each writing transistor Tr2 being turned ON.

In a specific but non-limiting example, suppose that the voltage of the signal line DTL is Vsig; the writing transistor Tr2 is turned ON; and the switching transistor Tr3 is turned OFF, when each organic EL device 13 emits light. In this situation, the timing generation circuit 22 may change the voltage of the control line CTL2 from Voff to Von on a pixel row basis to turn the switching transistor Tr4 ON. As a result, when each organic EL device 13 emits light, the signal voltage Vsig may be written into the memory circuit 12A (i.e., storage capacitor Cs2) on a pixel row basis to cause a voltage (Vcc−Vsig) to be applied across the storage capacitor Cs2 (at T13, FIG. 4).

After elapse of a certain period of time (e.g., after elapse of one horizontal period), the timing generation circuit 22 may change the voltage of the control line CTL2 from Von to Voff on a pixel row basis to turn the switching transistor Tr4 OFF (at T14). In this situation, the writing transistor Tr2 may remain ON, and thus the voltage of the signal line DTL may be inputted as it is to the node A between the switching transistor Tr3 and the writing transistor Tr2. Meanwhile, the switching transistor Tr4 may be OFF, and thus the voltage stored by the storage capacitor Cs2 may remain as the voltage (Vcc−Vsig) without any change. In this situation, the switching transistor Tr3 may remain OFF, and therefore the gate-source voltage Vgs of the driving transistor Tr1 may not be changed, thus causing a current Ids to flow into the organic EL device 13.

[Extinction]

Next, the controller 20 and the driver 30 may extinguish the organic EL device 13. In a specific but non-limiting example, the controller 20 and the driver 30 may extinguish the organic EL device 13 in all of the pixels 11 altogether when each organic EL device 13 emits light.

In a specific but non-limiting example, when each organic EL device 13 emits light, the power supply circuit 23 may decrease the voltage of the power supply line DSL from Vcc to Vss in all of the pixels 11 altogether (at T1). In this situation, the fixed voltage Vss may be smaller than a sum of a threshold voltage Vthe1 and a cathode voltage Vcat of the organic EL device 13 (Vthe1+Vcat). Thus, when the source voltage Vs is decreased to Vss, the organic EL device 13 is extinguished, and a terminal, of the driving transistor Tr1, on side of the power supply line DSL may be a source. In this situation, the gate voltage Vg may also be decreased by coupling via the storage capacitor Cs1, thus causing the anode of the organic EL device 13 to be charged to Vss.

[Threshold Correction Preparation]

Next, the controller 20 and the driver 30 may prepare threshold correction, in which the gate-source voltage Vgs of the driving transistor Tr1 may be made closer to the threshold voltage Vth of the driving transistor Tr1. In a specific but non-limiting example, during a period of time when each organic EL device 13 is extinguished (V-blanking period), the controller 20 and the driver 30 may prepare the threshold correction in all of the pixels 11 altogether.

Figure 5:
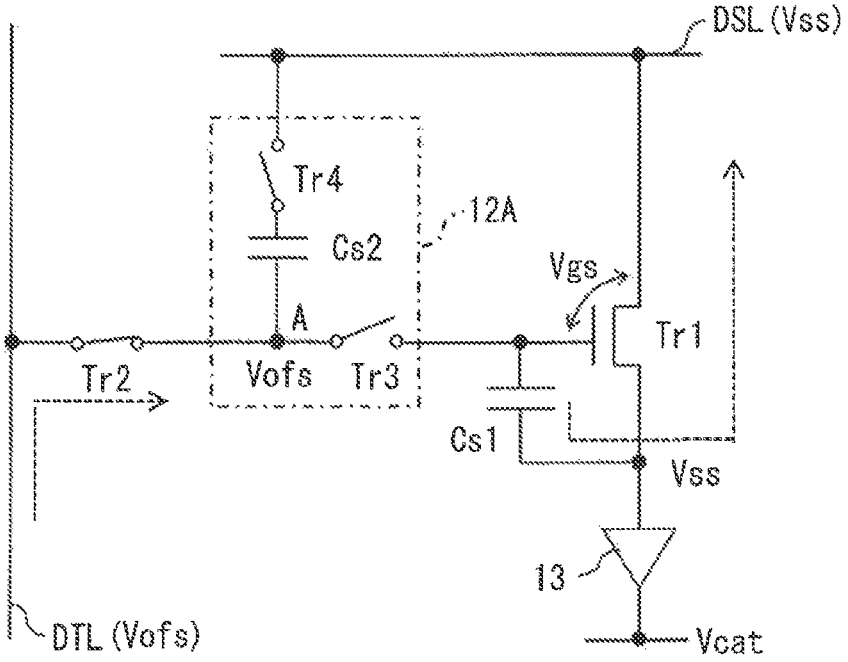
FIG. 5 illustrates an example of an operation of a pixel.
Figure 6:
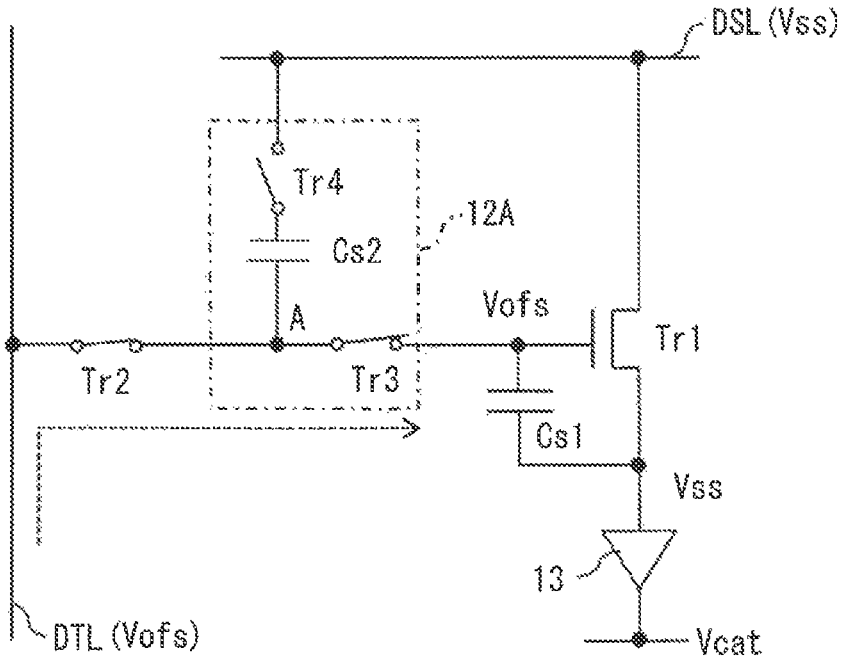
FIG. 6 illustrates an example of an operation of a pixel.

In a specific but non-limiting example, the horizontal selector 31 may first change the voltage of the signal line DTL from Vsig to Vofs in all of the pixels 11 altogether (at T2, FIG. 5). Accordingly, the voltage Va of the node A may be changed from Vsig to Vofs. Thereafter, the timing generation circuit 22 may change the voltage of the control line CTL1 from Voff to Von in all of the pixels 11 altogether to turn the switching transistor Tr3 ON (at T3, FIG. 6). This brings the gate voltage Vg of the driving transistor Tr1 to Vofs. In this situation, the gate-source voltage Vgs of the driving transistor Tr1 may be a voltage (Vofs−Vss). The voltage (Vofs−Vss) may be greater than the threshold voltage Vth of the driving transistor Tr1. In other words, the fixed voltages Vofs and Vss may be set to allow the voltage (Vofs−Vss) to have a value greater than the threshold voltage Vth of the driving transistor Tr1.

[Threshold Correction]

Next, the controller 20 and the driver 30 may perform threshold correction. In a specific but non-limiting example, the controller 20 and the driver 30 may perform the threshold correction in all of the pixels 11 altogether when each organic EL device 13 is extinguished, i.e., during the V-blanking period.

Figure 7:
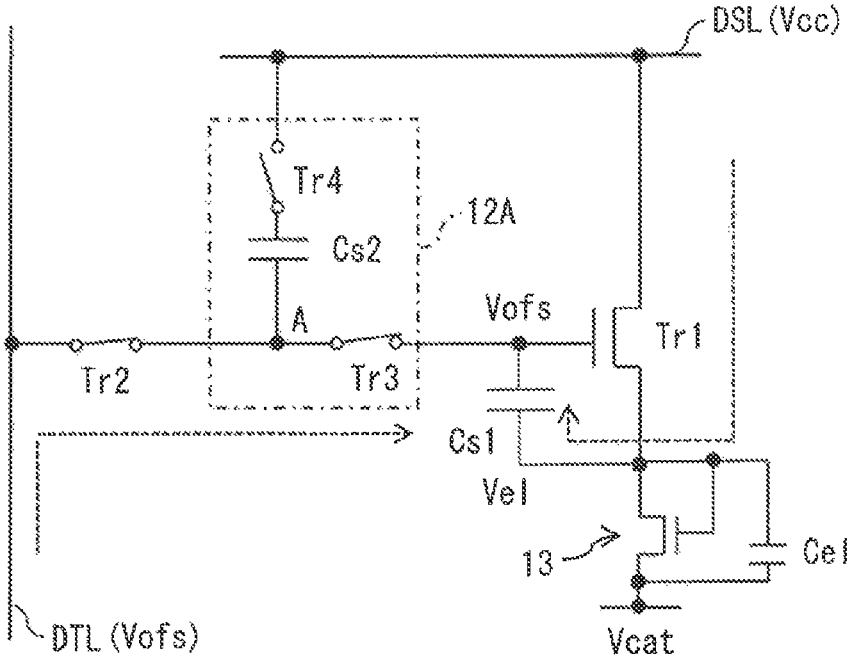
FIG. 7 illustrates an example of an operation of a pixel.
Figure 8:
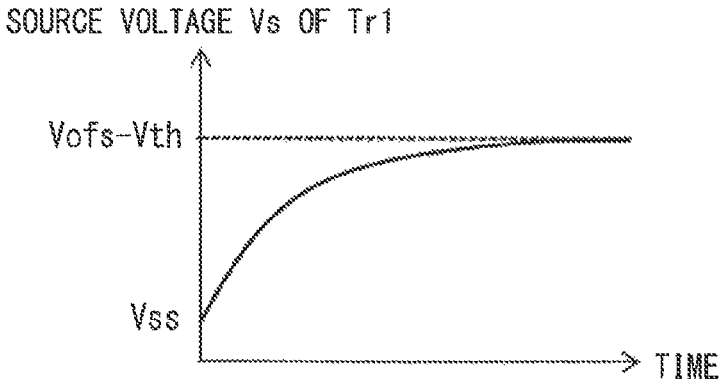
FIG. 8 illustrates an example of a temporal change in the source voltage of the driving transistor.
Figure 9:
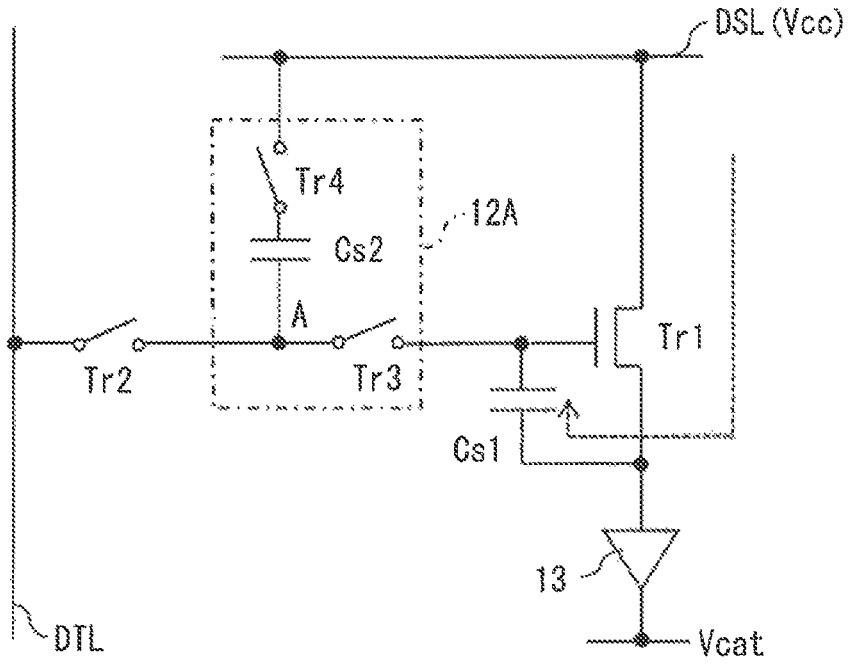
FIG. 9 illustrates an example of an operation of a pixel.

In a specific but non-limiting example, the power supply circuit 23 may increase the voltage of the power supply line DSL from Vss to Vcc in all of the pixels 11 altogether (at T4, FIG. 7). Accordingly, a current may flow between the drain and the source of the driving transistor Tr1 to cause the source voltage to be increased. Here, an equivalent circuit of the organic EL device 13 is represented by a diode and a device capacitor Ce1, as illustrated in FIG. 7. Thus, insofar as the source voltage Vs is smaller than the sum of the threshold voltage Vthe1 and the cathode voltage Vcat of the organic EL device 13 (Vthe1+Vcat), the current flowing between the drain and the source of the driving transistor Tr1 may charge the storage capacitor Cs1 and the device capacitor Ce1. The source voltage Vs may be the anode voltage Ve1 of the organic EL device 13. As illustrated in FIG. 8, the source voltage Vs, i.e., the anode voltage Ve1 may be increased with elapse of time, for example. As a result, the storage capacitor Cs1 may be charged to cause the gate-source voltage Vgs to come closer to Vth.

Thereafter, the control scanner 32 may decrease the voltage of the control line WSL from Von to Voff in all of the pixels 11 altogether. Further, the timing generation circuit 22 may decrease the voltage of the control line CTL1 from Von to Voff in all of the pixels 11 altogether. This causes the writing transistor Tr2 and the switching transistor Tr3 to be turned OFF (at T5 and T6, FIG. 9). Accordingly, the gate of the driving transistor Tr1 may be brought into a floating state.

Figure 10:
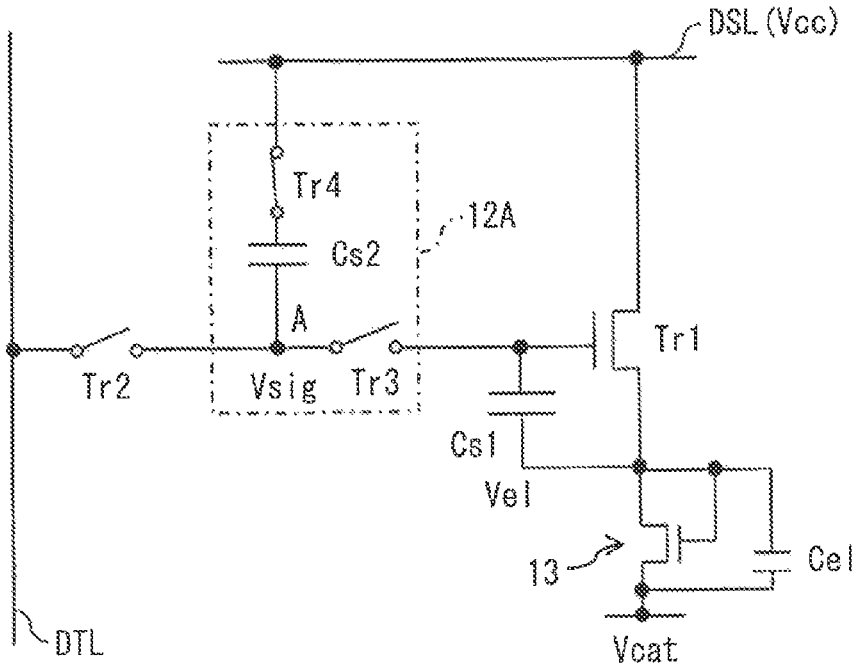
FIG. 10 illustrates an example of an operation of a pixel.

Next, the control scanner 32 may increase the voltage of the control line CTL2 from Voff to Von in all of the pixels 11 altogether, thereby turning the switching transistor Tr4 ON (at T7, FIG. 10). This causes respective switching transistors Tr4 of all of the pixels 11 to be turned ON all at once. As a result, the node A may have the signal voltage Vsig.

[Signal Voltage Transfer and Mobility Correction]

Next, the controller 20 and the driver 30 may perform the signal voltage transfer and the mobility correction. In a specific but non-limiting example, the controller 20 and the driver 30 may perform the signal voltage transfer and the mobility correction in each of the pixels 11 altogether when each organic EL device 13 is extinguished, i.e., during the V-blanking period. The controller 20 and the driver 30 may transfer the signal voltage Vsig written into the storage capacitor Cs2 to the gate of the driving transistor Tr1 in each of the pixels 11 altogether. The controller 20 and the driver 30 may turn each of the switching transistors Tr3 and Tr4 ON, with each writing transistor Tr2 being turned OFF, thereby transferring the signal voltage Vsig written into the storage capacitor Cs2 to the gate of the driving transistor Tr1 in each of the pixels 11 altogether.

Figure 11:
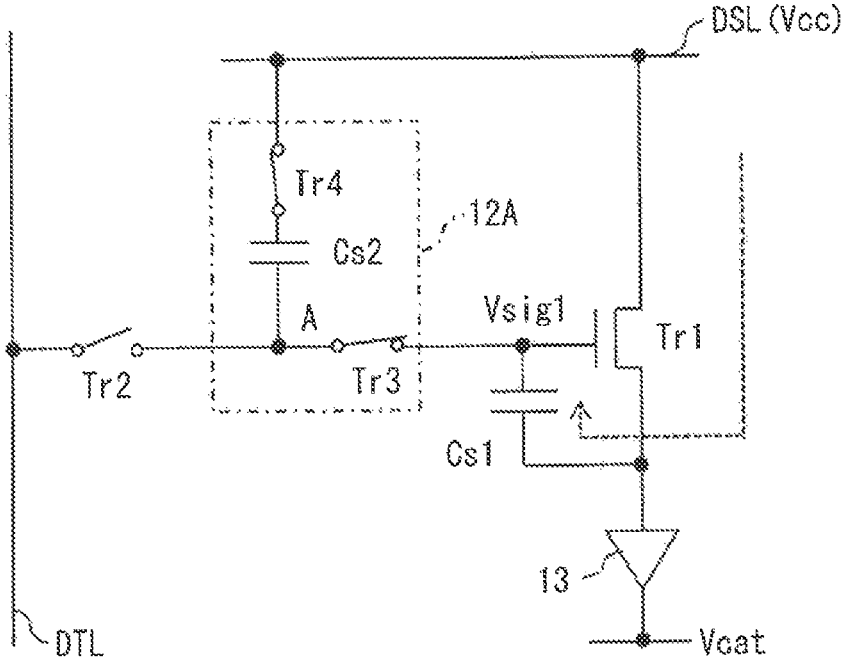
FIG. 11 illustrates an example of an operation of a pixel.

In a specific but non-limiting example, the timing generation circuit 22 may increase the voltage of the control line CTL1 from Voff to Von in all of the pixels 11 altogether, thereby turning the switching transistor Tr3 ON (at T8, FIG. 11). This causes charge partitioning to occur via the switching transistor Tr3, thus allowing the gate voltage Vg of the driving transistor Tr1 to have a voltage value Vsig1 corresponding to a gradation. As a result, the driving transistor Tr1 may cause a current that is based on the gate voltage Vg of the driving transistor Tr1, from the power supply line DSL, thus allowing the source voltage Vs of the driving transistor Tr1 to be increased with elapse of time. In this situation, in a case where the source voltage Vs of the driving transistor Tr1 does not exceed the sum of the threshold voltage Vthe1 and the cathode voltage Vcat of the organic EL device 13 (Vthe1+Vcat), the current of the driving transistor Tr1 may charge the storage capacitor Cs1 and the device capacitor Ce1. In this situation, the threshold correction of the driving transistor Tr1 has been completed. Thus, the current flowing between the drain and the source of the driving transistor Tr1 reflects the mobility of the driving transistor Tr1.

[Emission]

Next, the controller 20 and the driver 30 may cause the organic EL device 13 to emit light. In a specific but non-limiting example, the controller 20 and the driver 30 may cause the organic EL device 13 to emit light in all of the pixels 11 altogether when each organic EL device 13 is extinguished.

Figure 12:
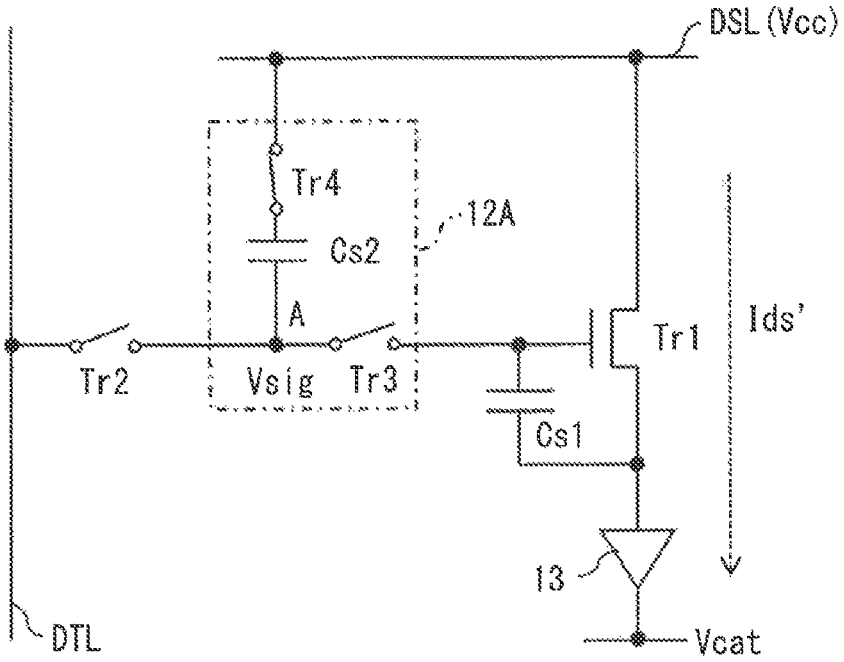
FIG. 12 illustrates an example of an operation of a pixel.

In a specific but non-limiting example, the timing generation circuit 22 may decrease the voltage of the control line CTL1 from Von to Voff in all of the pixels 11 altogether, thereby turning the switching transistor Tr3 OFF (at T9, FIG. 12). Accordingly, the gate of the driving transistor Tr1 may be brought into the floating state, thus causing the current Ids to flow between the drain and the source of the driving transistor Tr1, which leads to increase in the source voltage Vs. In association with the increase in the source voltage Vs, the gate voltage Vg may also be increased. The source voltage Vs may be increased to a voltage Vx at which a current Ids' flows into the organic EL device 13, thus causing the organic EL device 13 to emit light at desired luminance.

[Effects]

Description is given next of effects of the display unit 1 according to the present example embodiment.

An organic EL display unit typically performs a correction operation that reduces irregular emission luminance caused by an irregular threshold voltage and irregular mobility of the driving transistor. When the correction operation is performed, Vcc and Vss have been applied line-sequentially to a plurality of power supply lines provided for respective pixel rows. Vcc is a voltage that causes the organic EL device to emit light, thus making it necessary to design a circuit, that drives the power supply lines line-sequentially, to have a large current capability. This has resulted in large width of the circuit in accordance with the large current capability, thus making it difficult to have a narrow bezel.

Therefore, it is conceivable, for example, that the respective power supply lines may be driven altogether instead of driving them line-sequentially. For example, it is conceivable that the threshold correction may be performed for all of the pixels altogether during the blanking period and thereafter the mobility correction and the signal writing may be performed on a pixel row basis. In such a case, it is possible to eliminate the circuit that drives the power supply lines line-sequentially, thus making it possible to achieve the narrow bezel by the size of such an eliminated circuit that drives the power supply lines line-sequentially. In this method, however, time from the threshold correction to the signal writing (standby time) varies for each pixel row. Thus, an amount of a leak current generated during the standby time also varies for each pixel row. This results in occurrence of shading. In addition, it is difficult, in this method, to have longer emission time, thus causing flickering to occur.

The method disclosed in, for example, Japanese Unexamined Patent Application Publication No. 2013-200541 is conceivable in order to have longer emission time while driving respective power supply lines altogether. In the method disclosed in Japanese Unexamined Patent Application Publication No. 2013-200541, the signal voltage is written into the memory circuit in the pixel circuit during the emission period, and the signal voltage having been written into the memory circuit is written all at once into respective driving transistors of all of pixels during the blanking period, thus causing all of the pixels to emit light all at once. In the pixel circuit disclosed in Japanese Unexamined Patent Application Publication No. 2013-200541, however, parasitic capacitance of two transistors in the memory circuit is added to the gate of the driving transistor, thus causing a bootstrap gain to be small. This results in lowered capability in threshold correction and in mobility correction. In order to avoid the lowered capability, it is conceivable to have a larger area of the storage capacitor between the gate and the source of the driving transistor, for example. In such a case, however, a distance between wiring lines in the pixel circuit becomes smaller by such a larger area of the storage capacitor, thus making it difficult to obtain high yield. In addition, a charge amount stored by the storage capacitor between the gate and the source of the driving transistor is more likely to vary, thus making unevenness and roughness more likely to occur on a displayed screen.

In contrast, according to the present example embodiment, only parasitic capacitance of one transistor, i.e., the switching transistor Tr3 is added to the gate of the driving transistor, in the memory circuit 12A provided in each pixel circuit 12. This enables the bootstrap gain to be larger than the bootstrap gain obtained by the method disclosed in Japanese Unexamined Patent Application Publication No. 2013-200541, thus making it possible to suppress a loss of the bootstrap gain caused by the parasitic capacitance of the memory circuit 12A. As a result, it becomes possible to improve the capability of each of the threshold correction and the mobility correction, as compared with the method disclosed in Japanese Unexamined Patent Application Publication No. 2013-200541, thus making it possible to achieve an image of high display quality. In addition, in the present example embodiment, it is unnecessary to make the distance between the wiring lines in the pixel circuit 12 smaller to such a degree that the yield may be lowered. In addition, neither unevenness nor roughness is likely to occur on a displayed screen.

Further, in the present example embodiment, the source or the drain of the driving transistor Tr1 may be electrically coupled to one of the plurality of power supply lines DSL having a mutually common potential in each of the pixels 11. This makes it possible to omit the circuit that drives the plurality of power supply lines DSL line-sequentially, thus enabling the display panel 10 to have a narrower bezel.

Furthermore, in the present example embodiment, a terminal, of the source and the drain of the switching transistor Tr4, on side opposite to the storage capacitor Cs2 may be electrically coupled to the power supply line DSL. This makes it possible to allow a wiring line coupled to the switching transistor Tr4 and a wiring line coupled to the driving transistor Tr1 to be in common, thus enabling the display panel 10 to have a narrower bezel.

Moreover, in the present example embodiment, the signal voltage Vsig is written into the memory circuit 12A (i.e., storage capacitor Cs2) on a pixel row basis. Further, the signal voltage Vsig written into the memory circuit 12A (i.e., storage capacitor Cs2) is transferred to the gate of the driving transistor Tr1 in each of the pixels 11 altogether. This enables the signal voltage Vsig to be written into the memory circuit 12A (i.e., storage capacitor Cs2) when each organic EL device 13 emits light. Thus, it becomes possible to transfer the signal voltage Vsig written into the memory circuit 12A (i.e., storage capacitor Cs2) to the gate of the driving transistor Tr1, in each of the pixels 11 altogether, when each organic EL device 13 is extinguished. As a result, it becomes possible to increase an emission period of each of the pixels 11, as compared with a case where the signal voltage Vsig is written when each organic EL device 13 is extinguished.

[2. Modification Example]

Description is given below of a modification example of the display unit 1 according to the foregoing example embodiment. It is to be noted that the same reference numerals are assigned to components common to those of the display unit 1 of the foregoing example embodiment.

Further, descriptions of the components common to those of the display unit 1 of the foregoing example embodiment are omitted where appropriate.

Figure 13:
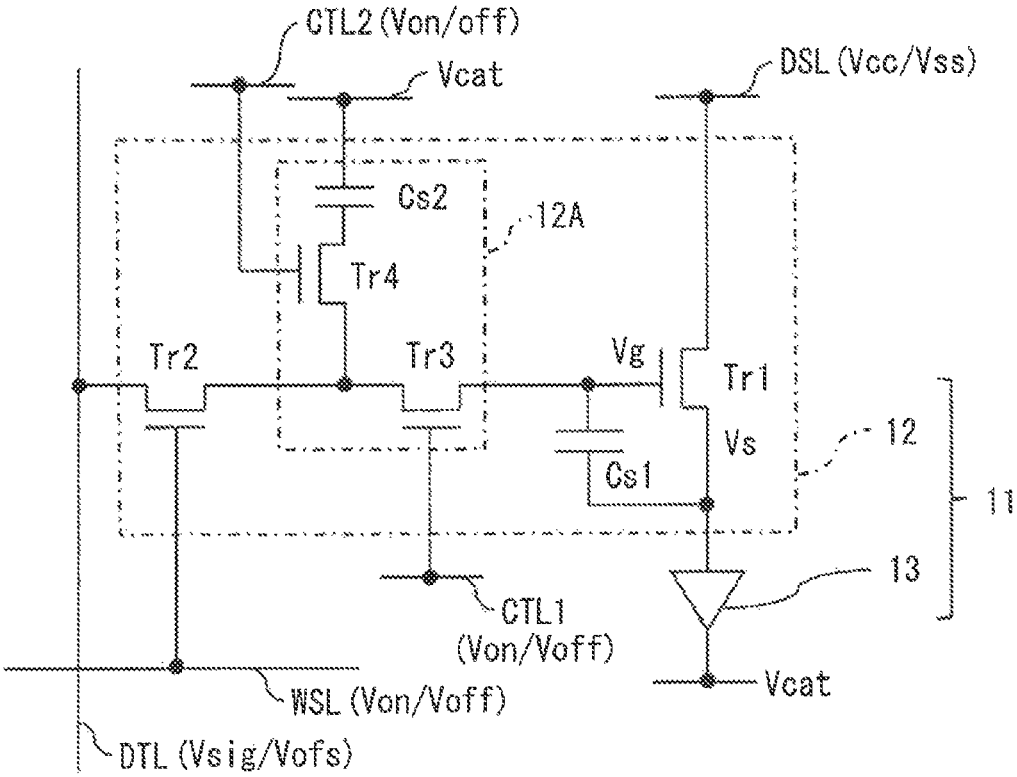
FIG. 13 illustrates a modification example of a circuit configuration of each pixel.

In the foregoing example embodiment, positions of the storage capacitor Cs2 and the switching transistor Tr4 may be reversed. For example, as illustrated in FIG. 13, the switching transistor Tr4 may be provided between the storage capacitor Cs2 and the switching transistor Tr3. In this situation, for example, the source or the drain of the switching transistor Tr4 may be coupled to one end of the storage capacitor Cs2. A terminal, of the source and the drain of the switching transistor Tr4, that is not coupled to the storage capacitor Cs2 may be coupled to the node A. Further, in this situation, the other end of the storage capacitor Cs2 may be electrically coupled to a wiring line that provides a fixed voltage (a wiring line to which the cathode voltage Vcat is applied, in this example).

Even in a case where the memory circuit 12A has such a configuration, it is possible to drive each of the pixels 11 using the voltage signals illustrated in (A) to (E) of FIG. 3, for example. Hence, also in the present modification example, effects similar to those of the foregoing example embodiment are achieved.

[3. Application Example]

Description is given below of an application example of the display unit 1 described in any one of the foregoing example embodiment and modification example thereof (hereinafter, referred to as "the foregoing example embodiment, etc."). The display unit 1 of the foregoing example embodiment is applicable to a display unit of an electronic apparatus in various fields, which may display an image signal supplied from the outside or an image signal generated inside, as an image or as a picture. Non-limiting examples of the electronic apparatus with such a display unit may include a television, a digital camera, a laptop personal computer, a portable terminal unit such as a mobile phone, and a video camera.

Figure 14:
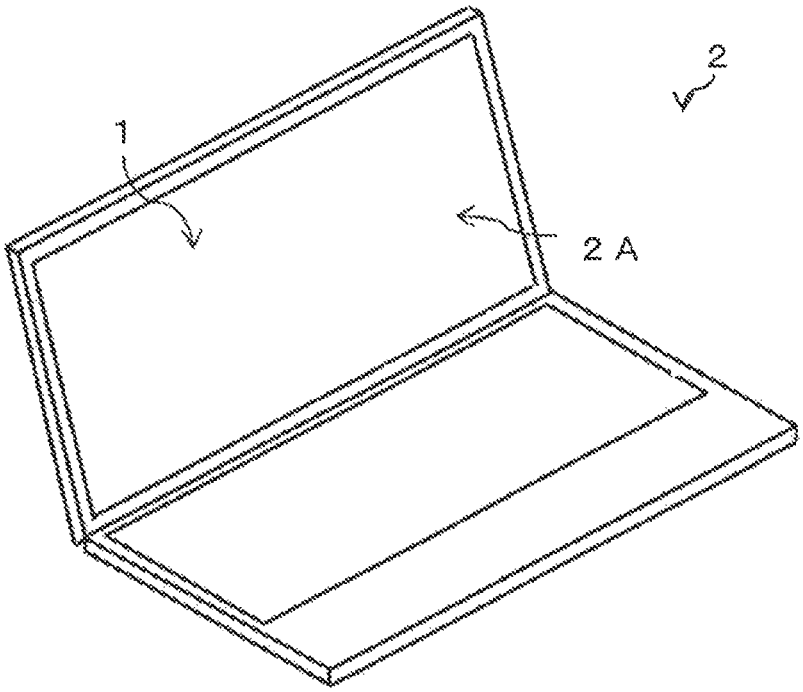
FIG. 14 is a perspective view of an outer appearance of one application example of a display unit according to any one of the above-mentioned embodiment and the modification example thereof.

FIG. 14 illustrates a schematic configuration example of an electronic apparatus 2 according to the present application example. The electronic apparatus 2 may be a laptop foldable personal computer including a display surface 2A on a main surface of one of two plate-shaped casings, for example. The electronic apparatus 2 may include the display unit 1 according to the foregoing example embodiment, etc., as well as the display panel 10 at a location of the display surface 2A, for example. The display unit 1 is provided in the present application example, thus making it possible to achieve an image of high display quality.

Although the technology has been described hereinabove by way of example with reference to the example embodiment, the modification example, and the application example, the technology is not limited thereto but may be modified in a wide variety of ways. Moreover, the effects described hereinabove are mere examples. The effects according to an embodiment of the technology are not limited to those described hereinabove. The technology may further include other effects in addition to the effects described hereinabove.

For example, the technology may also have the following configurations.

(1)

A display panel with a plurality of pixels, the pixels each including a light-emitting device and a pixel circuit, the pixel circuit including a driving transistor configured to control a current flowing into the light-emitting device, a memory circuit configured to store a signal voltage corresponding to an image signal, and apply the stored signal voltage to a gate of the driving transistor, a writing transistor configured to write the signal voltage into the memory circuit, and a first storage capacitor provided between the gate of the driving transistor and an anode of the light-emitting device, the memory circuit including a second storage capacitor configured to store the signal voltage, a first switching transistor provided between the gate of the driving transistor and the second storage capacitor, and a second switching transistor that is provided between the second storage capacitor and the first switching transistor, or provided on side opposite to the first switching transistor with respect to the second storage capacitor.

(2)

The display panel according to (1), in which, in each of the pixels, a source or a drain of the driving transistor is electrically coupled to one of a plurality of power supply lines that have a mutually common potential.

(3)

The display panel according to (1) or (2), in which a terminal, of a source and a drain of the second switching transistor, on side opposite to the second storage capacitor is electrically coupled to the one of the power supply lines.

(4)

The display panel according to (1) or (2), in which a terminal, of a source and a drain of the second switching transistor, on side opposite to the second storage capacitor is electrically coupled to a node between the first switching transistor and the writing transistor.

(5)

A display unit including:

a display panel with a plurality of pixels, the pixels each including a light-emitting device and a pixel circuit; and a driving circuit configured to drive the plurality of pixels, the pixel circuit including a driving transistor configured to control a current flowing into the light-emitting device, a memory circuit configured to store a signal voltage corresponding to an image signal, and apply the stored signal voltage to a gate of the driving transistor, a writing transistor configured to write the signal voltage into the memory circuit, and a first storage capacitor provided between the gate of the driving transistor and an anode of the light-emitting device, the memory circuit including a second storage capacitor configured to store the signal voltage, a first switching transistor provided between the gate of the driving transistor and the second storage capacitor, and a second switching transistor that is provided between the second storage capacitor and the first switching transistor, or provided on side opposite to the first switching transistor with respect to the second storage capacitor.

(6)

The display unit according to (5), in which in each of the pixels, a source or a drain of the driving transistor is electrically coupled to one of a plurality of power supply lines that have a mutually common potential, the driving circuit writes, on a pixel row basis, the signal voltage into the second storage capacitor, and the driving circuit transfers the signal voltage that is written into the second storage capacitor to the gate of the driving transistor in each of the pixels altogether.

(7)

The display unit according to (6), in which the driving circuit writes, on the pixel row basis, the signal voltage into the second storage capacitor by turning, on the pixel row basis, the second switching transistor ON, with the writing transistor being turned ON, and the driving circuit transfers the signal voltage that is written into the second storage capacitor to the gate of the driving transistor in each of the pixels altogether by turning, in each of the pixels, both of the first switching circuit and the second switching transistor ON, with the writing transistor being turned OFF.

(8)

The display unit according to (6), in which the driving circuit writes the signal voltage into the second storage capacitor when each of the light-emitting devices emits light.

(9)

The display unit according to (6), in which the driving circuit transfers the signal voltage that is written into the second storage capacitor to the gate of the driving transistor in each of the pixels altogether when each of the light-emitting devices is extinguished.

In the display panel and the display unit according to the respective embodiments of the technology, the pixel circuits each include the memory circuit. In the memory circuit, the first switching transistor is provided between the second storage capacitor and the gate of the driving transistor. The second storage capacitor stores the signal voltage. The memory circuit further includes the second switching transistor. The second switching transistor is provided between the second storage capacitor and the first switching transistor. In an alternative embodiment, the second switching transistor is provided on side opposite to the first switching transistor with respect to the second storage capacitor. This makes it possible to prevent parasitic capacitance of the memory circuit from being added to the gate of the driving transistor, thus allowing for suppression of loss of a bootstrap gain caused by the parasitic capacitance of the memory circuit.

According to the display panel and the display unit of the respective embodiments of the technology, it is possible to suppress the loss of the bootstrap gain caused by the parasitic capacitance of the memory circuit, thus allowing for improvement in the correction capability by the above-described correction operation. It is to be noted that the effects described herein are not necessarily limitative, and may be any effects described in the disclosure.

Although the technology has been described in terms of exemplary embodiments, it is not limited thereto. It should be appreciated that variations may be made in the described embodiments by persons skilled in the art without departing from the scope of the technology as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" as used herein can allow for a degree of variability in a value or range. Moreover, no element or component in this disclosure is intended to be dedicated to the public regardless of whether the element or component is explicitly recited in the following claims.

What is claimed is:

1. A display panel comprising:

a plurality of pixels, the pixels each including a light-emitting device and a pixel circuit, the pixel circuit including:

a driving transistor configured to control a current flowing into the light-emitting device;

a memory circuit configured to store a signal voltage corresponding to an image signal, and apply the stored signal voltage to a gate of the driving transistor;

a writing transistor configured to write the signal voltage into the memory circuit; and a first storage capacitor provided between the gate of the driving transistor and an anode of the light-emitting device, and the memory circuit including:

a second storage capacitor configured to store the signal voltage, a first switching transistor connected to the gate of the driving transistor and to a first terminal of the second storage capacitor, and a second switching transistor connected to a second terminal of the second storage capacitor and to a first power supply line.

2. The display panel according to claim 1, wherein the first power supply line is one of a plurality of power supply lines that have a mutually common potential, and, in each of the pixels, a source or a drain of the driving transistor is electrically coupled to a corresponding one of the plurality of power supply lines.

3. The display panel according to claim 2, wherein the second switching transistor includes a first current terminal and a second current terminal, the first current terminal being connected to the first power supply line, the second current terminal being connected to the the second terminal of the second storage capacitor.

4. A display unit comprising:

a display panel including a plurality of pixels, the pixels each including a light-emitting device and a pixel circuit; and a driving circuit configured to drive the plurality of pixels, the pixel circuit including:

a driving transistor configured to control a current flowing into the light-emitting device, a memory circuit configured to store a signal voltage corresponding to an image signal, and apply the stored signal voltage to a gate of the driving transistor, a writing transistor configured to write the signal voltage into the memory circuit, and a first storage capacitor provided between the gate of the driving transistor and an anode of the light-emitting device, and the memory circuit including:

a second storage capacitor configured to store the signal voltage, a first switching transistor connected to the gate of the driving transistor and to a first terminal of the second storage capacitor, and a second switching transistor connected to a second terminal of the second storage capacitor and to a first power supply line.

5. The display unit according to claim 4, wherein the first power supply line is one of a plurality of power supply lines that have a mutually common potential, in each of the pixels, a source or a drain of the driving transistor is electrically coupled to a corresponding one of the plurality of power supply lines, the driving circuit writes, on a pixel row basis, the signal voltage into the second storage capacitor, and the driving circuit transfers the signal voltage that is written into the second storage capacitor to the gate of the driving transistor in each of the pixels altogether.

6. The display unit according to claim 5, wherein the driving circuit writes, on the pixel row basis, the signal voltage into the second storage capacitor by turning, on the pixel row basis, the second switching transistor ON, with the writing transistor being turned ON, and the driving circuit transfers the signal voltage that is written into the second storage capacitor to the gate of the driving transistor in each of the pixels altogether by turning, in each of the pixels, both of the first switching circuit and the second switching transistor ON, with the writing transistor being turned OFF.

7. The display unit according to claim 5, wherein the driving circuit writes the signal voltage into the second storage capacitor when each of the light-emitting devices emits light.

8. The display unit according to claim 5, wherein the driving circuit transfers the signal voltage that is written into the second storage capacitor to the gate of the driving transistor in each of the pixels altogether when each of the light-emitting devices is extinguished.

9. A display panel comprising:

a plurality of pixels, the pixels each including a light-emitting device and a pixel circuit, the pixel circuit including:

a driving transistor configured to control a current flowing into the light-emitting device;

a memory circuit configured to store a signal voltage corresponding to an image signal, and apply the stored signal voltage to a gate of the driving transistor;

a writing transistor configured to write the signal voltage into the memory circuit; and a first storage capacitor provided between the gate of the driving transistor and an anode of the light-emitting device, and the memory circuit including:

a second storage capacitor configured to store the signal voltage, the second storage capacitor including a first terminal and a second terminal, the second terminal being connected to a power supply line, a first switching transistor including a first current terminal and a second current terminal, the first current terminal being connected to the gate of the driving transistor, and a second switching transistor including a first current terminal and a second current terminal, the first current terminal being connected to the second current terminal of the first switching transistor, and the second current terminal being connected to the first terminal of the second storage capacitor.

* * * * *